US010538826B2

(12) United States Patent
Park et al.

(10) Patent No.: US 10,538,826 B2
(45) Date of Patent: Jan. 21, 2020

(54) WATER-LEACHABLE ALLOY-MELT-SWAPPING PROCESS AND POROUS METAL MANUFACTURED USING THE SAME

(71) Applicant: SEOUL NATIONAL UNIVERSITY R&DB FOUNDATION, Seoul (KR)

(72) Inventors: Eunsoo Park, Gyeonggi-do (KR); Kooknoh Yoon, Seoul (KR); Jein Lee, Seoul (KR); Wookha Ryu, Gyeongsangbuk-do (KR); Geun Hee Yoo, Seoul (KR)

(73) Assignee: Seoul National University R&DB Foundation, Seoul (KR)

( * ) Notice: Subject to any disclaimer, the term of this patent is extended or adjusted under 35 U.S.C. 154(b) by 173 days.

(21) Appl. No.: 15/685,012

(22) Filed: Aug. 24, 2017

(65) Prior Publication Data

US 2018/0057912 A1 Mar. 1, 2018

(30) Foreign Application Priority Data

Aug. 26, 2016 (KR) ..... 10-2016-0108908

(51) Int. Cl.
*C22B 9/22* (2006.01)
*C22C 1/02* (2006.01)
(Continued)

(52) U.S. Cl.
CPC ..... *C22B 9/22* (2013.01); *C22C 1/02* (2013.01); *C22C 1/08* (2013.01); *C23C 26/02* (2013.01);
(Continued)

(58) Field of Classification Search
CPC ..... C22B 9/22; C22C 1/02; C22C 1/08; C23F 4/04; C23C 26/02; Y10T 428/12479
See application file for complete search history.

(56) References Cited

U.S. PATENT DOCUMENTS

2012/0295129 A1* 11/2012 Kato ..... C23C 26/02 428/613
2015/0057144 A1* 2/2015 Erlebacher ..... C22C 32/0047 501/96.1
2017/0218480 A1* 8/2017 Park ..... C22C 3/005

FOREIGN PATENT DOCUMENTS

CN 105624455 A * 6/2016
WO 2013/128797 A1 9/2013

OTHER PUBLICATIONS

McCue, Ian; Bernard Gaskey, Bryan Crawford, & Jonah Erlebacher. "Local heterogeneity in the mechanical properties of bicontinous composites made by liquid metal dealloying." Applied Physics Letters. 109. 6 pages. https://doi.org/10.1063/1.4971776 (Year: 2016).*
(Continued)

*Primary Examiner* — Tima M. McGuthry-Banks
(74) *Attorney, Agent, or Firm* — Westeman, Champlin & Koehler, P.A.; Amanda M. Prose

(57) ABSTRACT

Disclosed is an AMS process using a water-leachable alloy that reacts with water and dissolves, and a porous metal manufactured using the same. An AMS precursor including element groups that are selected in consideration of the relationship of heat of mixing with the water-leachable alloy composition to be subjected to the AMS process is immersed in the alloy melt, thus manufacturing a bi-continuous structure alloy. The bi-continuous structure alloy is subjected to dealloying using water, thus manufacturing the porous metal. The water-leachable alloy is a Ca-based alloy having high reactivity to water and high oxidation resistance at high temperatures, and a dealloying process thereof is performed using only pure water, unlike a conventional dealloying process performed using a toxic etching solution of a strong
(Continued)

acid/strong base. The metal porous body has high elongation, a large surface area, and low thermal conductivity.

11 Claims, 9 Drawing Sheets
(9 of 9 Drawing Sheet(s) Filed in Color)

(51) Int. Cl.
*C22C 1/08* (2006.01)
*C23F 4/04* (2006.01)
*C23C 26/02* (2006.01)

(52) U.S. Cl.
CPC ..... *C23F 4/04* (2013.01); *Y10T 428/12479* (2015.01)

(56) References Cited

OTHER PUBLICATIONS

Notice of Allowance issued for related KR patent application No. 10-2016-0108908, dated Apr. 23, 2018.
Office Action issued for related KR patent application No. 10-2016-0108908, dated Aug. 28, 2017.
McCue, Ian, et al. "Size effects in the mechanical properties of bulk bicontinuous Ta/Cu nanocomposites made by liquid metal dealloying." Advanced Engineering Materials (2015).
Yu, Seung-Geun, et al. "Three-dimensional bicontinuous porous graphite generated in low temperature metallic liquid." Carbon 96 (2016): 403-410.

* cited by examiner

WATER-LEACHABLE ALLOY-MELT-SWAPPING PROCESS AND POROUS METAL MANUFACTURED USING THE SAME

CROSS-REFERENCE TO RELATED APPLICATION

This application claims the priority benefit of Korean Patent Application No. 10-2016-0108908, filed on Aug. 26, 2016 in the Korean Intellectual Property Office, the disclosure of which is incorporated herein by reference.

BACKGROUND OF THE INVENTION

1. Field of the Invention

The present invention relates to a water-leachable alloy-melt-swapping (AMS) process in which a water-leachable alloy reacts with water and dissolves, and a porous metal manufactured using the same. More particularly, the present invention relates to a porous metal and a method of manufacturing the same, in which a precursor, including element groups that are selected in consideration of the relationship of heat of mixing with a water-leachable alloy composition to be subjected to an AMS process, is immersed in the water-leachable alloy melt, thus manufacturing a bi-continuous structure alloy including the water-leachable alloy due to a swapping process between the elements. The bi-continuous structure alloy is subjected to dealloying using only pure water instead of an etching solution, thus manufacturing the porous metal.

2. Description of the Related Art

Porous metals have been actively studied as they are known to be applicable to structural materials, owing to mechanical properties such as excellent elongation, and functional materials having properties such as large surface area and low thermal conductivity. A chemical dealloying process using an etching solution has been actively studied as the most simple and effective method for manufacturing porous metals. However, conventional processes have been limited to the manufacture of only precious metal-based metals acting as positive electrodes due to the difference in corrosion potential between constituent elements.

In a liquid metal dealloying (LMD) process which has been studied recently as a solution to this problem, a high-temperature liquid metal is reacted with a precursor having a specific thermodynamic relationship with the metal to manufacture a bi-continuous complex structure alloy, and the bi-continuous complex structure alloy is subjected to dealloying using an etching solution, thus forming the porous structure of a metal having a low corrosion potential other than noble metals.

However, the conventional LMD process has problems in that pure metals such as magnesium (Mg) and bismuth (Bi), which are easily oxidized in a high-temperature atmosphere, must be maintained in a liquid phase at a high temperature for a long period of time, and in that a toxic etching solution such as a strong acid/strong base must be used in order to manufacture porous bodies. Accordingly, there is demand for the development of a more convenient and eco-friendly new process.

SUMMARY OF THE INVENTION

Accordingly, the present invention has been made keeping in mind the above problems occurring in the related art, and an object of the present invention is to provide a porous metal and a method of manufacturing the same. The porous metal is manufactured using a more convenient and eco-friendly AMS process, and in the AMS process, the use of a pure metal liquid having low oxidation resistance, which is considered to be a drawback of a conventional LMD process, is avoided, a novel water-leachable alloy is designed so as to be more stably maintained in a liquid phase at high temperatures, and a water-leachable dealloying process is performed through a process using pure water instead of a process using an etching solution during the conventional LMD process.

In order to accomplish the above object, the present invention provides an AMS process. The AMS process includes preparing a water-leachable alloy having excellent oxidation resistance, preparing an AMS precursor including a composition having a relationship of both positive (+) and negative (−) heats of mixing with elements contained in the alloy, manufacturing a bi-continuous structure alloy by immersing the prepared precursor in a melt prepared by dissolving the water-leachable alloy prepared during the former step, and obtaining the porous metal by reacting the bi-continuous structure alloy in pure water instead of a toxic etching solution.

In addition, in the step of preparing the water-leachable alloy having the excellent oxidation resistance according to the present invention, metal elements (element group I) that are soluble in water are used, and the alloy is designed by controlling the composition thereof so as to be stably maintained in a liquid phase even in an oxidation atmosphere at a high temperature that is higher than a melting point thereof. The element group I constituting the alloy melt includes Ca and Mg which are known to have excellent water solubility. Particularly, the element group I is a Ca-based alloy and is represented by the composition of $Ca_xMg_{100-x}$ ($55 \leq x \leq 82$ at. %). Since the above-described composition region has a eutectic point having a relatively low melting point of about 445° C., the metal elements are very stable in a liquid phase, compared to a conventional pure metal, and include water-leachable alloy elements, thus being easily dissolved in pure water. Further, in the step of preparing the AMS precursor, an alloy is manufactured, which includes an element group II, having positive (+) heat of mixing with elements constituting the element group I, and an element group III, having negative (−) heat of mixing with elements constituting the element group I. Next, in the step of manufacturing the bi-continuous structure alloy, the AMS precursor including both the element groups II and III prepared during the former step is immersed in the melt of the alloy including the element group I and thus reacted, thereby manufacturing the bi-continuous structure alloy. Subsequently, in the step of manufacturing the porous metal, the porous metal is obtained by reacting the manufactured bi-continuous structure alloy in pure water to thus perform the dealloying process of the water-leachable alloy.

In the present invention, the AMS precursor to be immersed in the liquid metal is an alloy that includes one or more elements selected from the element group II including Ti, V, Cr, Mn, Fe, Co, Zr, Nb, Mo, Hf, Ta, W, and Re, which have positive (+) heat of mixing with both Ca and Mg of the element group I, and one or more elements selected from the element group III including Al, Si, P, Ni, Cu, Zn, Ga, Ge, As, Pd, Ag, Cd, In, Sn, Sb, Pt, Au, Hg, Tl, Pb, and Bi, which have negative (−) heat of mixing with both Ca and Mg of the element group I.

In addition, the AMS precursor according to the present invention is obtained by alloying one or more elements selected from the element group II, acting as the main element of the finally manufactured porous metal, and one or more elements selected from the element group III, which reacts with the alloy melt at high temperatures to dissolve and flow into the melt. The composition of the element groups II and III of the AMS precursor is represented by (element group II)$_{100-y}$(element group III)$_y$ ($5 \leq y \leq 95$ at. %). In the above-described composition, when the value of y is less than 5, it is difficult to maintain the structure of the porous metal after dealloying. When the value of y is more than 95, it is difficult to form the structure of pores connected to each other through the dealloying process using water. In the step of preparing raw materials, it is possible to control the internal porosity of the finally obtained porous body by controlling the composition ratio of the element group II and the element group III, or it is possible to obtain microstructures having various shapes by controlling process conditions such as agitation conditions, immersion time, and the temperature of the melt to thus adjust a position exchange rate between the elements due to diffusion.

Finally, a porous metal manufactured using an alloy-melt-swapping process according to another aspect of the present invention includes a porous body that includes an alloy material including at least one element selected from among Ti, V, Cr, Mn, Fe, Co, Zr, Nb, Mo, Hf, Ta, W, and Re constituting the element group II as a main element, and has pores therein. The metal porous body exhibits a further characteristic of a porous structure due to the pores as well as characteristics of a conventional metal material, thereby securing specific physical properties.

The metal porous body may be obtained by performing dealloying of the bi-continuous structure alloy, which includes both a phase including the elements of the element group I undergoing swapping during the AMS process, as the main element, and another phase including the element group II, in water. It is possible to control the internal porosity by adjusting the composition ratio of constituent elements, or it is possible to obtain various porosities by controlling process conditions such as agitation conditions, immersion time, and the temperature of the melt to thus adjust the position exchange rate between the elements due to diffusion.

As described above, in a water-leachable alloy-based AMS process, porous structures of various metals having a low corrosion potential other than noble metals can be more conveniently and effectively provided than in a conventional dealloying process. Further, an alloy composition including Ca soluble in water as a main element according to the present invention can be completely dissolved in pure water within 72 hours (about 1.4 wt. % per hour), which is useful and eco-friendly, unlike a conventional dealloying process which is performed in a toxic etching solution such as a strong acid/strong base, and thus may create byproduct due to the toxic etching solution. Moreover, the alloy composition is manufactured by specifying surrounding compositions based on eutectic reaction so that oxidation resistance thereof is excellent at high temperatures. Accordingly, the alloy composition has excellent liquid-phase stability and excellent oxidation resistance in the atmosphere at high temperatures, compared to a melt of a single metal composition used in a conventional LMD process.

Furthermore, the porous metal provided in the present invention has a structure in which pores are distributed in a metal material. The porous metal has properties such as high elongation and large surface area due to its porous structure, in addition to excellent mechanical properties of a basic metal material, and the porosity and the shape of the ligament are controlled by controlling process conditions.

BRIEF DESCRIPTION OF THE DRAWINGS

The patent application or file contains at least one drawing executed in color. Copies of this patent or patent application publication with color drawing(s) will be provided by the Office upon request and payment of the necessary fee.

The above and other objects, features and advantages of the present invention will be more clearly understood from the following detailed description taken in conjunction with the accompanying drawings, in which.

DESCRIPTION OF THE PREFERRED EMBODIMENTS

Figure 1:
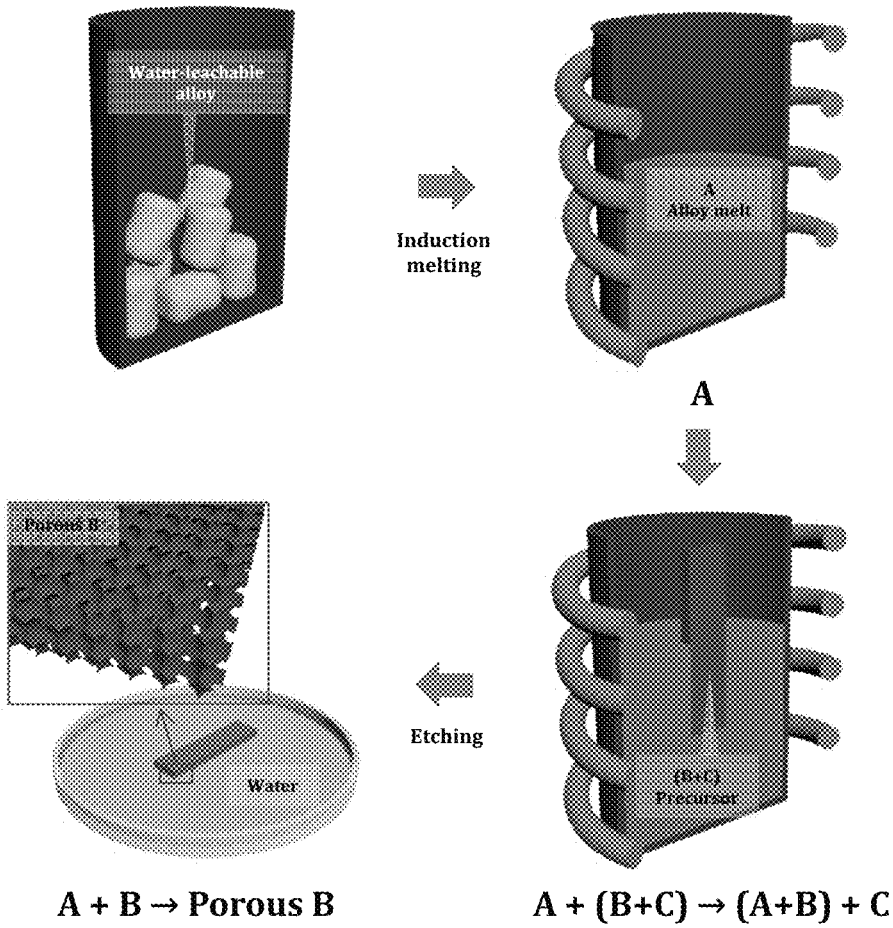
FIG. 1 is a view schematically showing an AMS process according to the present invention.

The present invention will be described more fully hereinafter with reference to the accompanying drawings, in which embodiments of the present invention are shown so as to be easily understood by those skilled in the art. The present invention may be embodied in many different forms, but is not limited to the embodiments described herein. In order to clearly illustrate the present invention, parts not related to the description are omitted in the drawings, and the same reference numerals are used for the same or similar components throughout the specification. In the case of publicly known technologies, a detailed description thereof will be omitted.

In the specification, when any portion "includes" any component, this means that the portion does not exclude other components but may further include other components unless otherwise stated.

The present invention relates to a water-leachable alloy-melt-swapping (AMS) process in which a water-leachable alloy reacts with water and dissolves in water, and a porous metal manufactured using the same. More particularly, the present invention relates to a porous metal and a method of manufacturing the same, in which an AMS precursor including element groups that are selected in consideration of the relationship of heat of mixing with a water-leachable alloy composition to be subjected to an AMS process is immersed in the water-leachable alloy melt, thus manufacturing a bi-continuous structure alloy, and the bi-continuous structure alloy is subjected to dealloying using water, thus manufacturing the porous metal.

FIG. 1 schematically shows the AMS process according to the present invention. As shown in the drawing, an AMS precursor (B+C) to be immersed in a liquid metal may easily form a bi-continuous structure alloy (A+B) in the AMS process due to a special relationship of heat of mixing with the water-leachable alloy (A). In the bi-continuous structure alloy, A, constituting the water-leachable alloy, is subjected to dealloying in pure water, thus manufacturing a B alloy porous body having pores. In addition, in the AMS process of the present invention, elements of an element group II (B), having a positive (+) heat of mixing with an element group I (A) constituting the liquid metal alloy, and an element group III (C), having a negative (−) heat of mixing with the element group I (A), are simultaneously alloyed to manufacture the AMS precursor (B+C). The precursor is immersed in the high-temperature alloy melt so that a reaction between the element group I (A) and the element group III (C) is promoted, thus inducing dissolving of the elements of the element group III (C) and flowing of the elements to the alloy melt. Further, the element group I (A) occupies a space occupied by the element group III (C) in the AMS precursor, thus finally obtaining the bi-continuous structure alloy (A+B) including the element group I (A) having large reactivity to water and the element group II (B) having no reactivity to water. Subsequently, this alloy (A+B) is immersed in pure water and subjected to a dealloying process, thereby manufacturing a porous alloy including the element group II (B) as a main element.

Figure 2:
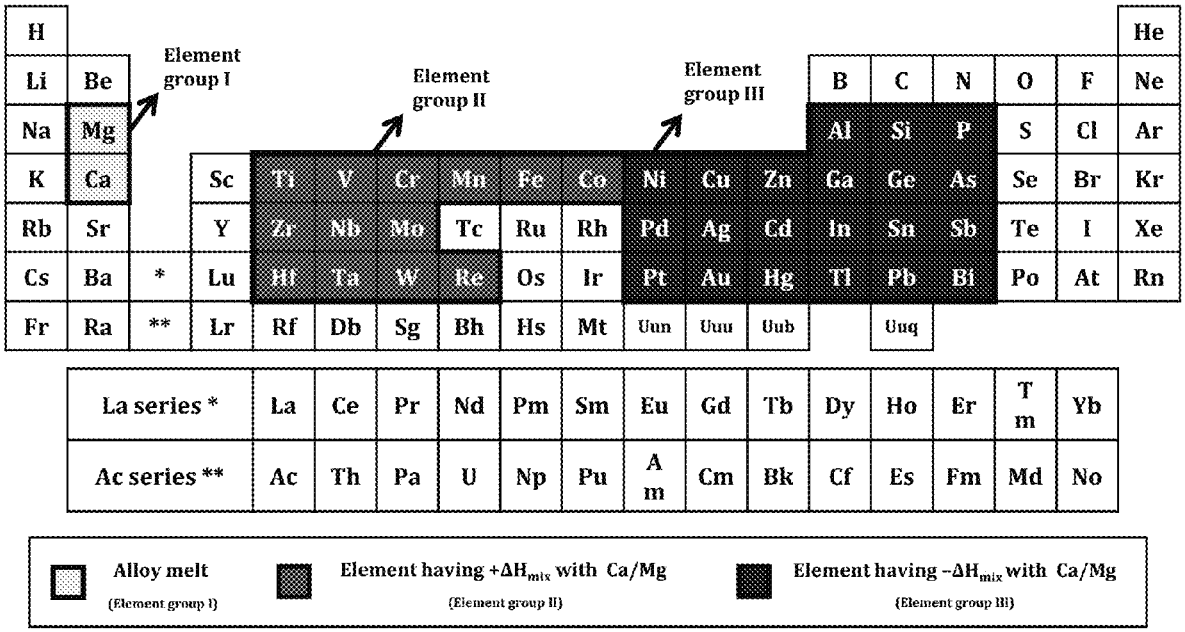
FIG. 2 shows constituent elements of element groups I, II, and III of the present invention on a periodic table.

The AMS process using the water-leachable alloy according to the present invention includes preparing the water-leachable alloy having excellent oxidation resistance, preparing the AMS precursor including a composition having a relationship of both positive (+) and negative (−) heats of mixing with the alloy elements, manufacturing the bi-continuous structure alloy by immersing the prepared precursor in a melt prepared by dissolving the water-leachable alloy prepared during the former step, and obtaining the porous metal by reacting the bi-continuous structure alloy in pure water instead of a toxic etching solution. The water-leachable alloy element having excellent oxidation resistance is designated by the element group I, the alloy elements having positive and negative heats of mixing with the elements constituting the element group I are designated by the element groups II and III, respectively, and the element groups I, II, and III are shown on the periodic table in FIG. 2. The element groups will be systematically described below.

Manufacture of Water-Leachable Liquid Alloy Having Excellent Oxidation Resistance In the present step, the water-leachable liquid alloy having excellent oxidation resistance for a water-leachable alloy-melt-swapping process will be described. The metal element constituting the alloy melt for the AMS process must satisfy the following conditions: 1) the metal element must have a low melting point so that the AMS precursor is not melted when the AMS precursor is immersed in the alloy melt, 2) the metal element must have excellent oxidation resistance so as not to be easily oxidized even when dissolved in the atmosphere, and finally 3) the metal element must include a water-leachable material so that dealloying is feasible even when the metal element is immersed in pure water, as in an etching solution environment.

Figure 3:
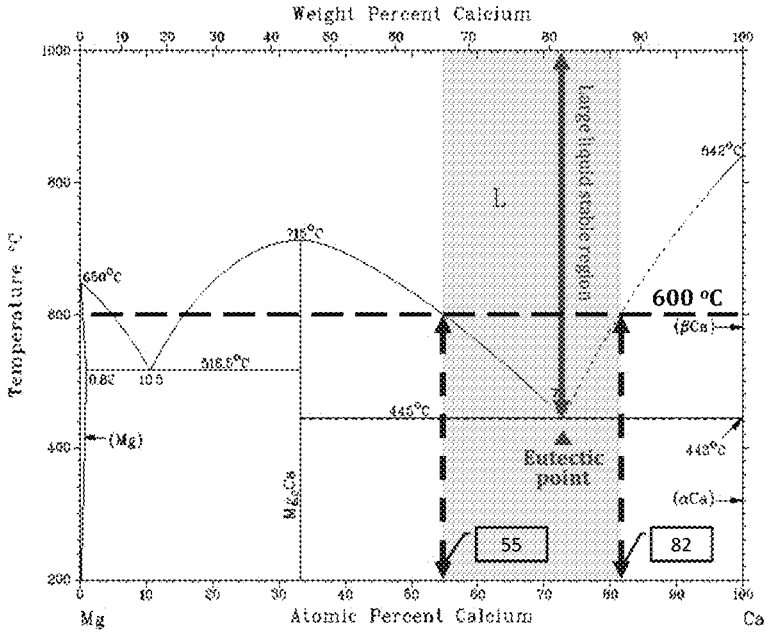
FIG. 3 shows the composition and the temperature range of a water-leachable alloy of the present invention in a Ca—Mg binary system phase diagram.

For this purpose, Ca and Mg, which are known to actively react with water, are selected as the element group I constituting the water-leachable alloy. As shown in FIG. 3, the composition is limited to the composition region having a melting point of 600° C. or less including the eutectic composition shown in the drawing so that the melting point of the alloy is reduced and at the same time the stability of its liquid phase is increased to thus increase oxidation resistance in the atmosphere. Meanwhile, the water solubility is drastically reduced as the content of Ca is reduced. Therefore, except for a Mg-based eutectic composition region, the composition of the liquid alloy is ultimately limited to $Ca_xMg_{100-x}$ ($55 \leq x \leq 82$ at. %), which is the intersection region of the two conditions.

Figure 4:
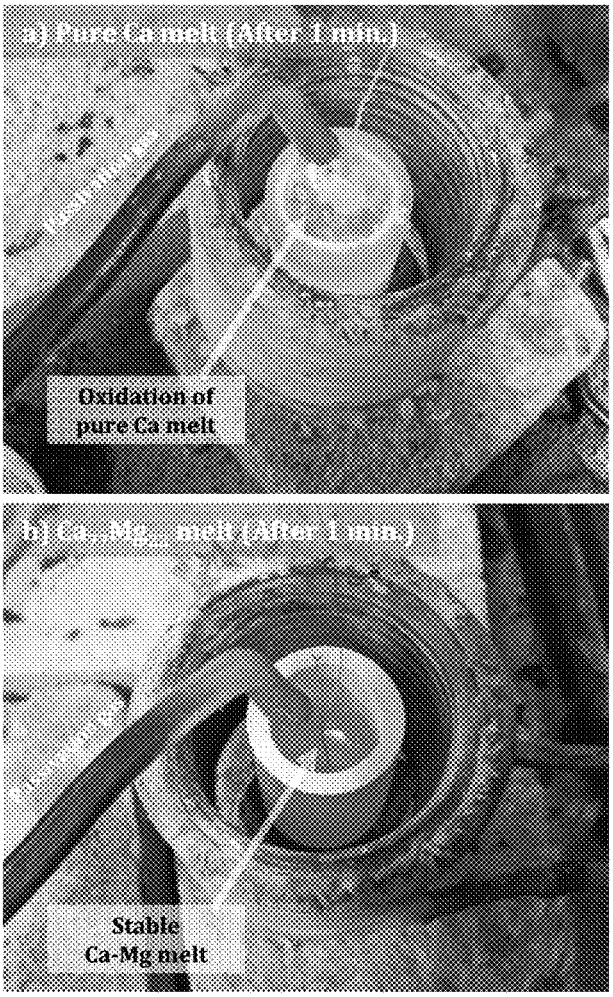
FIG. 4 is a photograph showing a difference in oxidation resistance of (a) pure calcium and (b) a calcium alloy melt of the present invention in the atmosphere.

FIG. 4 shows images of (a) pure Ca and (b) $Ca_{77}Mg_{23}$ alloy melts which are maintained for 1 minute in an argon-spraying atmosphere using high-frequency induction melting which enables homogeneous melting using an agitation effect caused by an induced electromagnetic field. From the drawing, it can be confirmed that the Ca-based alloy melt of the present invention is not oxidized but is maintained in a stable liquid state, unlike pure Ca which is rapidly oxidized in one minute despite the protective effect of Ar spraying. Meanwhile, mother elements of the water-leachable alloy are limited by the above-described process. In addition, AMS precursors can be manufactured using other commercial heating processes including a resistance furnace, the temperature and vacuum conditions of which can be easily and precisely controlled.

In addition, for the water solubility evaluation of each liquid alloy, the water solubility of Ca—Mg alloys having various compositions is evaluated as shown in Table 1 below. Each water-leachable alloy is manufactured in a high-frequency melting furnace under a high-purity argon atmosphere, and is processed into a cubic shape so as to have a weight of 10 g, and the change in weight per hour in pure water is evaluated. With respect to the composition used, as shown in the table below, four compositions of pure Ca, pure Mg and eutectic points of the alloy of two metals are selected and compared.

The water-leachable liquid alloy according to the present invention is limited so that a water dissolution rate is at least 1.5 wt. % per hour, that is, a condition under which dealloying of the water-leachable alloy is completely performed within 72 hours due to the rapid reaction with pure water to thus dissolve the alloy in water. In fact, as can be seen from the table, the alloy of the Ca-based eutectic reaction composition, which is considered to be the least reactive among the liquid alloy compositions according to the present invention, is dissolved in water at a rate of 1.86 wt. % per hour. That is, it can be expected that the water-leachable liquid alloy according to the present invention exhibits excellent water solubility of at least 1.86 wt. % per hour even with pure water alone.

TABLE 1

| Classification | Water dissolution rate (per hour) (wt. %/hr.) 15 wt. % nitric acid | D.I. water | Note |
|---|---|---|---|
| Pure Ca | 28.56 | 15.1 | — |
| $Ca_{73}Mg_{27}$ | 24.3 | 1.86 | Eutectic point |
| $Ca_{10}Mg_{90}$ | 13.86 | 1.49 | Eutectic point |
| Pure Mg | 11.4 | 0.72 | — |

Manufacture of AMS Precursor

The manufacture of the AMS precursor for the AMS process, which is immersed in the liquid alloy to form the bi-continuous structure alloy, will be described below. The AMS precursor according to the present invention may be manufactured using an arc-melting method so that the AMS precursor includes a combination of the element group II and the element group III having a specific heat of mixing relationship with the composition of the liquid metal alloy. Since the arc melting method can offer elevated temperature easily to form a homogeneous solid solution, the precursor may be rapidly obtained in a bulk form, and impurities such as oxides and pores may be minimized, which leads to selection of the arc melting method. In addition to the above-described arc melting method, it is possible to manufacture the AMS precursor using an induction melting method exhibiting an agitation effect caused by an electromagnetic field during melting, a resistance heating method for precisely controlling a temperature, and a casting process such as a rapid solidification method which is useful to form a homogeneous solid solution. In addition to the casting method for directly melting a high-melting-point metal, it is possible to manufacture the AMS precursor according to spark plasma sintering using powder metallurgy, in which raw materials are shaped into powder, or using hot isostatic pressing sintering at a high temperature and pressure. The sintering method has merits in that the microstructures are precisely controlled and in that it is easy to manufacture a precursor having a desired shape.

Since the element group II (B) has a positive (+) heat of mixing with the elements constituting the element group I, which is the composition of the liquid metal alloy, its position is maintained in the precursor without reacting even in the high-temperature liquid metal. Accordingly, the element group II (B) constitutes the porous metal upon dealloying using water, which is a post-process. According to the present invention, Ti, V, Cr, Mn, Fe, Co, Zr, Nb, Mo, Hf, Ta, W, and Re are selected as the main constituent elements of the element group II (B). Further, the AMS precursor must include one or more elements among the element group II.

In addition, since the element group III (C) has a negative (−) heat of mixing with the element group I, the element group III easily reacts with the high-temperature liquid metal and diffuses. Accordingly, the element group III (C) may be exchanged in position with the constituent elements of the element group I in the precursor due to diffusion. According to the present invention, one or more among Al, Si, P, Ni, Cu, Zn, Ga, Ge, As, Pd, Ag, Cd, In, Sn, Sb, Pt, Au, Hg, Ti, Pb, and Bi must be included as the main constituent elements of the element group III (C).

In summary, when the AMS precursor manufactured under the above-described conditions is immersed in the high-temperature liquid metal of the alloy including the element group I, the element group II that is not reacted with the element group I may remain in the AMS precursor, and the element group I may occupy the space occupied by the element group III due to the reaction with the liquid metal, thus manufacturing a bi-continuous structure alloy including the element group I and the element group II.

Examples of the AMS precursors having various compositions according to the present invention is shown in Table 2 below, along with the crystal structure of the porous body, which is the final product. Each Example includes one to four types of elements among the elements of the element group II, and also includes elements of the element group III. The precursors of the Examples are manufactured using the arc melting method as described above, are reacted in the alloy melt of the $Ca_{73}Mg_{27}$ composition at 900° C. for 10 minutes, and are then dissolved in pure water for 72 hours.

TABLE 2

| Classification | Composition of AMS precursor (B + C) | Final product (B) |
|---|---|---|
| Example 1 | $Ti_{75}Ni_{25}$ | Porous BCC alloy |
| Example 2 | $Ti_{50}Ni_{50}$ | Porous BCC alloy |
| Example 3 | $Ti_{25}Ni_{75}$ | Porous BCC alloy |
| Example 4 | $W_{50}Ni_{45}Ag_5$ | Porous BCC alloy |
| Example 5 | $V_{50}Ni_{45}Pd_5$ | Porous BCC alloy |
| Example 6 | $Nb_{50}Ni_{45}Pt_5$ | Porous BCC alloy |
| Example 7 | $Mo_{50}Ni_{45}Au_5$ | Porous BCC alloy |
| Example 8 | $Hf_{50}Ni_{45}Zn_5$ | Porous BCC alloy |
| Example 9 | $Ta_{50}Ni_{45}Si_5$ | Porous BCC alloy |
| Example 10 | $Re_{50}Ni_{45}Ge_5$ | Porous BCC alloy |
| Example 11 | $(W_{90}Ti_{10})_{50}Ni_{50}$ | Porous BCC alloy |
| Example 12 | $(W_{90}V_{10})_{50}Ni_{50}$ | Porous BCC alloy |
| Example 13 | $(W_{90}Zr_{10})_{50}Ni_{50}$ | Porous BCC alloy |
| Example 14 | $(W_{90}Nb_{10})_{50}Ni_{50}$ | Porous BCC alloy |
| Example 15 | $(W_{90}Mo_{10})_{50}Ni_{50}$ | Porous BCC alloy |
| Example 16 | $(W_{90}Hf_{10})_{50}Ni_{50}$ | Porous BCC alloy |
| Example 17 | $(W_{90}Ta_{10})_{50}Ni_{50}$ | Porous BCC alloy |
| Example 18 | $(W_{90}Re_{10})_{50}Ni_{50}$ | Porous BCC alloy |
| Example 19 | $(W_{80}Ta_{10}V_{10})_{50}Ni_{50}$ | Porous BCC alloy |
| Example 20 | $(W_{80}Ta_{10}Mo_{10})_{50}Ni_{50}$ | Porous BCC alloy |
| Example 21 | $(W_{80}Ta_{10}Nb_{10})_{50}Ni_{50}$ | Porous BCC alloy |
| Example 22 | $(W_{70}Ta_{10}V_{10}Nb_{10})_{50}Ni_{50}$ | Porous BCC alloy |
| Example 23 | $Fe_{50}Ni_{50}$ | Porous FCC alloy |
| Example 24 | $Fe_{50}Cu_{50}$ | Porous FCC alloy |
| Example 25 | $Fe_{50}Al_{50}$ | Porous FCC alloy |
| Example 26 | $Mn_{50}Ni_{45}P_3Hg_2$ | Porous FCC alloy |
| Example 27 | $Co_{50}Ni_{45}In_3Sb_2$ | Porous FCC alloy |
| Example 28 | $Cr_{50}Ni_{45}Sn_3Tl_2$ | Porous FCC alloy |
| Example 29 | $(Fe_{90}Co_{10})_{50}Ni_{47}As_3$ | Porous FCC alloy |
| Example 30 | $(Fe_{90}Cr_{10})_{50}Ni_{47}Ga_3$ | Porous FCC alloy |
| Example 31 | $(Fe_{75}Mn_{25})_{75}Ni_{25}$ | Porous FCC alloy |
| Example 32 | $(Fe_{75}Mn_{25})_{50}Ni_{50}$ | Porous FCC alloy |
| Example 33 | $(Fe_{75}Mn_{25})_{25}N_{75}$ | Porous FCC alloy |
| Example 34 | $(Fe_{75}Mn_{25})_{75}Cu_{25}$ | Porous FCC alloy |
| Example 35 | $(Fe_{75}Mn_{25})_{50}Cu_{50}$ | Porous FCC alloy |
| Example 36 | $(Fe_{75}Mn_{25})_{25}Cu_{75}$ | Porous FCC alloy |
| Example 37 | $(Fe_{80}Co_{10}Cr_{10})_{50}Cu_{50}$ | Porous FCC alloy |
| Example 38 | $(Fe_{80}Mn_{10}Co_{10})_{50}Ni_{47}Pb_3$ | Porous FCC alloy |
| Example 39 | $(Fe_{80}Mn_{10}Cr_{10})_{50}Ni_{47}Bi_3$ | Porous FCC alloy |
| Example 40 | $(Fe_{80}Co_{10}Cr_{10})_{50}Ni_{47}Cd_3$ | Porous FCC alloy |
| Example 41 | $(Fe_{50}Mn_{30}Co_{10}Cr_{10})_{75}Ni_{25}$ | Porous FCC alloy |
| Example 42 | $(Fe_{50}Mn_{30}Co_{10}Cr_{10})_{50}Ni_{50}$ | Porous FCC alloy |
| Example 43 | $(Fe_{50}Mn_{30}Co_{10}Cr_{10})_{25}Ni_{75}$ | Porous FCC alloy |
| Example 44 | $(Fe_{50}Mn_{30}Co_{10}Cr_{10})_{75}Cu_{25}$ | Porous FCC alloy |
| Example 45 | $(Fe_{50}Mn_{30}Co_{10}Cr_{10})_{50}Cu_{50}$ | Porous FCC alloy |
| Example 46 | $(Fe_{50}Mn_{30}Co_{10}Cr_{10})_{25}Cu_{75}$ | Porous FCC alloy |

As shown in the above-described table, the AMS precursor (B+C) may easily form a porous body (B) having a desired phase even when the AMS precursor is an alloy of a quinary or higher system having four or more types of elements selected from the element group II, including the case where the AMS precursor is an alloy of a simple binary system. In addition, the results shown in the table indicate that the AMS process may be successfully completed even if the elements selected from the element group III are changed to various element groups. Finally, even when the ratio between the element groups II and III is adjusted, the porous body, which is the final product, can be obtained.

Manufacture of Bi-Continuous Structure Complex Material Using AMS Process

In the present step, the alloy of the complex structure manufactured in the present invention through various Examples will be exemplified in more detail with reference to the drawings. Particularly, as shown in Table 3 below, Examples 1 to 3, 31 to 33, and 41 to 43, and Examples 2a, 2b, and 2c, in which the immersion conditions are changed relative to Example 2, will be described in detail in the present specification.

TABLE 3

| Classification | Composition of AMS precursor | Process time | Process temperature | Ligament thickness |
|---|---|---|---|---|
| Example 1 | $Ti_{75}Ni_{25}$ | 10 min. | 900° C. | — |
| Example 2 | $Ti_{50}Ni_{50}$ | 10 min. | 900° C. | 2.1 μm |
| Example 3 | $Ti_{25}Ni_{75}$ | 10 min. | 900° C. | — |
| Example 2a | $Ti_{50}Ni_{50}$ | 10 min. | 1000° C. | 2.9 μm |
| Example 2b | $Ti_{50}Ni_{50}$ | 5 min. | 900° C. | 0.5 μm |
| Example 2c | $Ti_{50}Ni_{50}$ | 20 min. | 900° C. | 3.9 μm |
| Example 31 | $(Fe_{75}Mn_{25})_{75}Ni_{25}$ | 10 min. | 900° C. | — |
| Example 32 | $(Fe_{75}Mn_{25})_{50}Ni_{50}$ | 10 min. | 900° C. | — |
| Example 33 | $(Fe_{75}Mn_{25})_{25}Ni_{75}$ | 10 min. | 900° C. | — |
| Example 41 | $(Fe_{50}Mn_{30}Co_{10}Cr_{10})_{75}Ni_{25}$ | 10 min. | 900° C. | — |
| Example 42 | $(Fe_{50}Mn_{30}Co_{10}Cr_{10})_{50}Ni_{50}$ | 10 min. | 900° C. | — |
| Example 43 | $(Fe_{50}Mn_{30}Co_{10}Cr_{10})_{25}Ni_{75}$ | 10 min. | 900° C. | — |

The AMS precursor of each Example is an alloy including both the element such as Ti, Fe, Mn, Co, and Cr, corresponding to the element group II, and Ni, which is the representative element of the element group III, and is comprised of elements having positive (+) and negative (−) heats of mixing with Ca and Mg, constituting the liquid alloy melt. The composition of the element group II and the element group III constituting the AMS precursor is represented by (element group II)$_{100-y}$ (element group III)$_y$ ($5 \leq y \leq 95$ at. %). When the value of y is less than 5, it is difficult to maintain the structure of the porous metal after dealloying in water. When the value of y is more than 95, it is difficult to realize the structure of pores connected to each other using a dealloying process. The composition of the melt that is used is $Ca_{73}Mg_{27}$, which is a Ca-based eutectic composition. The change of the composition is thoroughly observed while changing the temperature and the immersion time in the melt.

Figure 5:
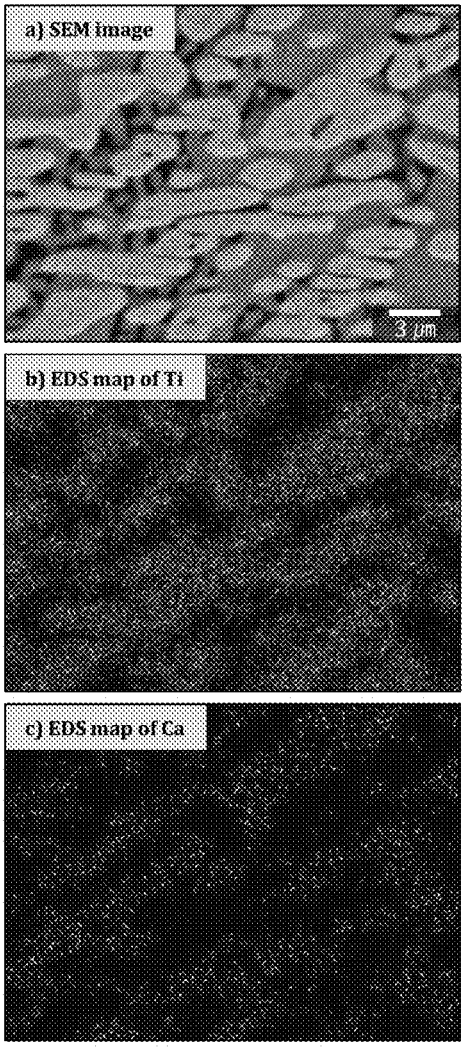
FIG. 5 shows the results of scanning electron microscopy (SEM) and energy dispersive spectroscopy (EDS) of the surface of a bi-continuous structure alloy, which is manufactured by immersing the AMS precursor of Example 2 according to the present invention in a $Ca_{73}Mg_{27}$ alloy melt for 10 minutes.

FIG. 5 shows the results of analysis of the surface of the bi-continuous structure alloy manufactured by immersing the AMS precursor of Example 2 in the alloy melt of the $Ca_{73}Mg_{27}$ composition according to the present invention. As can be seen from the SEM observation image (a), the bi-continuous structure alloy obtained using the AMS process is clearly divided into a Ti composition region (B) having a bright color and a Ca-rich composition region (A) having a dark color. This is consistent with the EDS mapping results of (b) to (c) of FIG. 5. That is, it can be confirmed that when the AMS precursor is immersed in the alloy melt including the element group I to react therewith, an element group II region and a region in which the element group III is replaced by the element group I are successfully separated.

Figure 6:
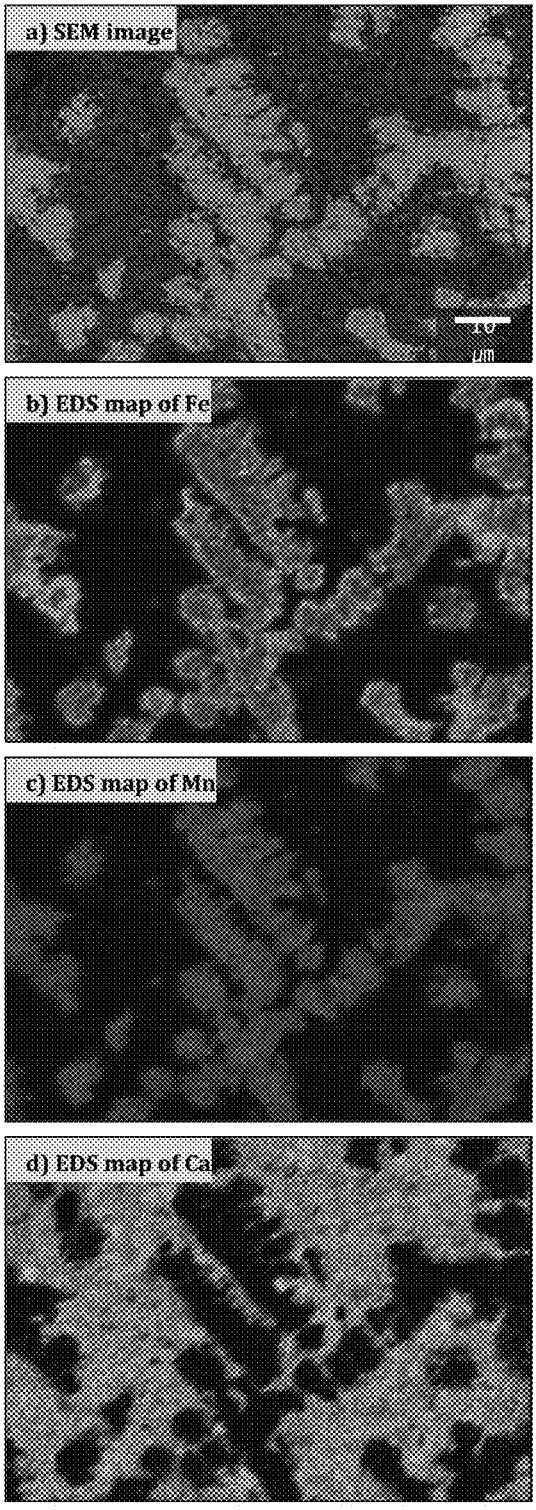
FIG. 6 shows the results of scanning electron microscopy (SEM) and energy dispersive spectroscopy (EDS) of the surface of a bi-continuous structure alloy, which is manufactured by immersing the AMS precursor of Example 32 according to the present invention in the $Ca_{73}Mg_{27}$ alloy melt for 10 minutes.
Figure 7:
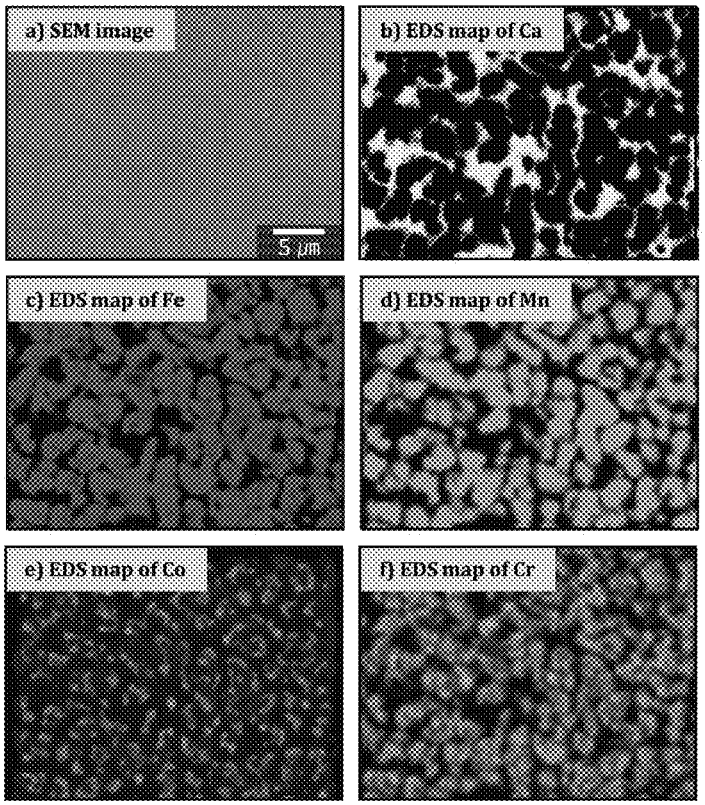
FIG. 7 shows the results of scanning electron microscopy (SEM) and energy dispersive spectroscopy (EDS) of the surface of a bi-continuous structure alloy, which is manufactured by immersing the AMS precursor of Example 42 according to the present invention in the $Ca_{73}Mg_{27}$ alloy melt for 10 minutes.

Meanwhile, FIGS. 6 and 7 are examples showing that the AMS process may be easily applied not only to a binary system alloy including one element selected from the element group II and one element selected from the element group III but also to a multi-system alloy. In fact, FIG. 6 shows the analysis result obtained using a process to which the AMS precursor of Example 32 is applied. As shown in the drawing, Fe and Mn, corresponding to the element group II, and Ca, representing the element group I, are separated from each other.

Further, from FIG. 7, showing the result of the AMS process performed by immersing Example 42 in the water-leachable alloy melt, it can be confirmed that even when a complicated AMS precursor of a quinary or higher system is used, a bi-continuous structure complex material is successfully formed. In addition, the material having a positive heat of mixing with the element group I constituting the liquid alloy remains in the bi-continuous structure complex material, and only the element group III, having a negative heat of mixing with the element group I, reacts with the melt, thus forming the complex material via position exchanging.

Manufacture of Porous Alloy Using Dissolution in Water

A process of manufacturing a porous alloy will be described in detail. The step of manufacturing the porous alloy, which is the final step according to the present invention, is performed by dealloying of the bi-continuous structure complex material, manufactured via a series of steps in pure water.

Figure 8:
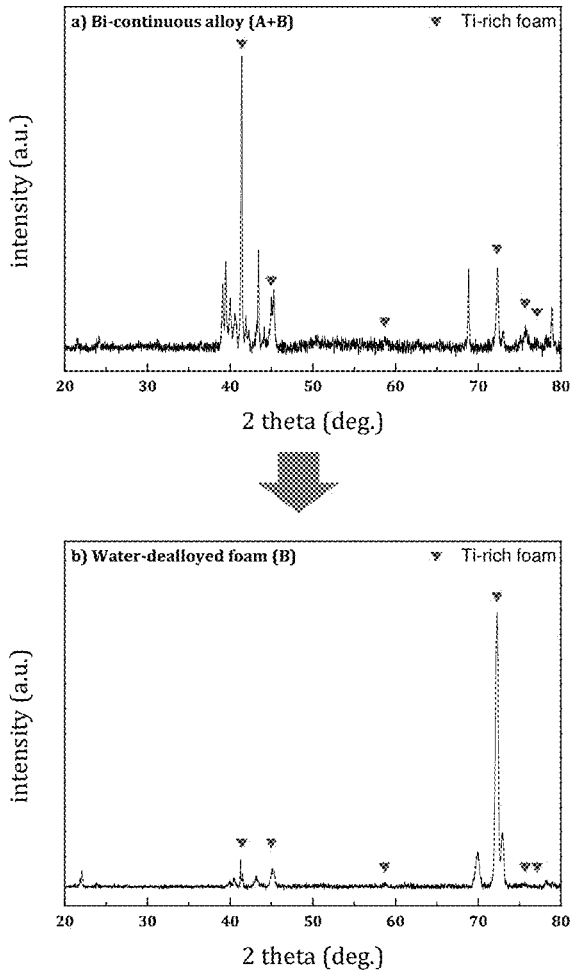
FIG. 8 shows (a) the result of X-ray diffraction analysis of a bi-continuous complex material which is manufactured in Example 2 and which is formed immediately after the AMS process, and (b) the result of X-ray diffraction analysis of a porous body obtained by performing dealloying of the bi-continuous complex material in pure water.

FIG. 8 shows the results of X-ray diffraction analysis of the bi-continuous structure alloy manufactured in Example 2 of the present invention and the porous alloy manufactured by performing dealloying of the bi-continuous structure alloy in pure water. In the present invention, for the purpose of completely dissolving the composition region of the water-leachable liquid alloy constituting the bi-continuous structure alloy, the dealloying process is performed in pure water at room temperature for 48 hours. As can be seen from (a) of FIG. 8, before the dealloying process in water, the Ca-based precipitation phase constituting the bi-continuous structure alloy and the Ti-rich phase constituting the ligament of the porous alloy are mixed with each other. In contrast, in the result (b) after dealloying is performed using water, most of the Ca-based precipitation phase is rapidly removed, and the peaks of the porous alloy of the Ti-rich composition are mostly observed.

These results show that the Ca-based alloy of liquid metal according to the present invention, effectively constitutes a bi-continuous structure alloy by reacting with the AMS precursor, and is easily dissolved in water by the dealloying process using water. A second phase may be completely removed by controlling a dealloying time, and a part thereof may remain in order to control the porosity. In addition, it can be seen that the porosity and the shape of the ligament are controlled depending on the concentration or the type of the etching solution used during the dealloying process.

Figure 9:
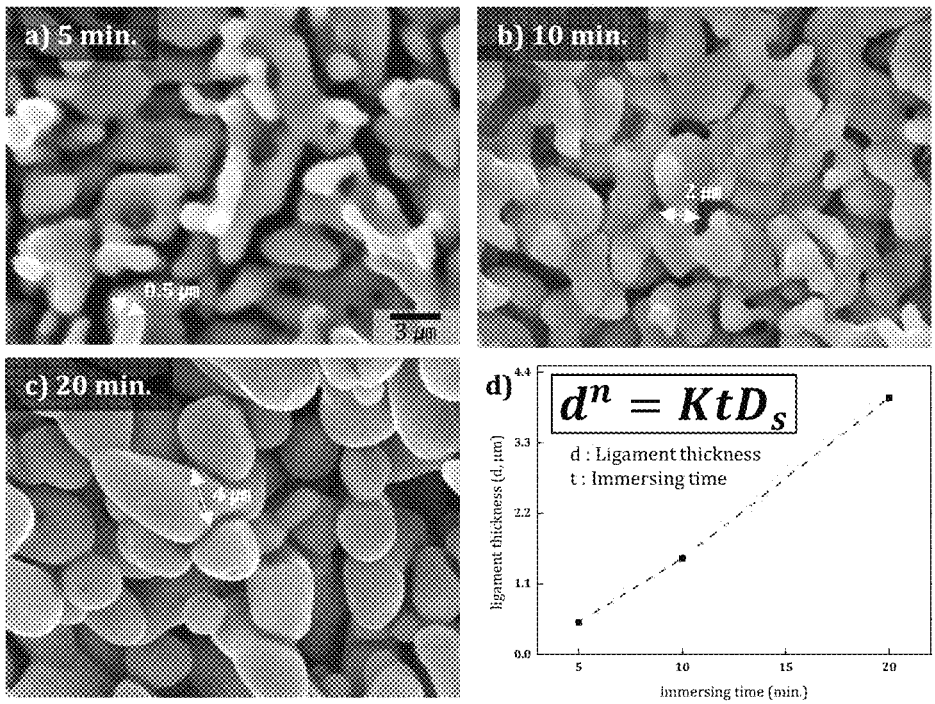
FIG. 9 shows images of the surface of the bi-continuous structure alloy manufactured in Example 2 after dealloying in water, which include scanning electron microscopic (SEM) images showing a change in microstructure obtained when the immersion time of the AMS precursor in a designed liquid metal is changed to be (a) 5 minutes, (b) 10 minutes, and (c) 20 minutes, and shows (d) the result of fitting of thickness changes of a ligament depending on the immersion time also.

FIG. 9 shows SEM observation images of the porous alloy manufactured according to the present invention. As in Example 2 and Examples 2b and 2c, the SEM images are obtained by observing the surface of the bi-continuous structure alloy, which is manufactured while the immersion time of the AMS precursor in the alloy melt is varied to be (a) 5 minutes, (b) 10 minutes, and (c) 20 minutes and which is subjected to dealloying using water, using a scanning electron microscope. When the dealloying is performed using an etching solution including nitric acid, since a stable interface is rapidly formed due to ions having a high reactivity, a smooth interface is obtained. On the other hand, when the dealloying is performed using water, having a reactivity lower than that of acid, since the reaction proceeds at a relatively slow rate, a multi-faced surface on which a stable crystal plane is exposed may be formed. The multi-faced interface thus formed may be useful for a process for improving the properties of the porous body by modifying the surface thereof. The higher the temperature of the alloy melt in the process, the faster the formation rate of the bi-continuous structure alloy using the AMS process. Further, as the immersion time is increased, the thickness of the ligament of the bi-continuous structure alloy corresponding to the thickness of the final porous body is proportionally increased (5 minutes: 0.5 μm; 10 minutes: 1.5 μm; and 20 minutes: 4 μm). In addition, as shown in (a) to (c) of the drawing, increasing the AMS process time may lead to a proportional increase in the thickness of the ligament between the Ti composition region and the liquid metal composition region, which causes a change in microstructure. Further, as shown in (d) of FIG. 9, the thickness of the ligament is fitted depending on the immersion time of the precursor in the alloy melt, and from the above-described results, it is confirmed that an increasing linear relationship is exhibited therebetween. This is considered to be based on the action of the mechanism of diffusion through the material surface on the position exchange between the elements, as in the equation shown in the drawing, when a general bi-continuous structure alloy is manufactured. It can be confirmed that this result is also applied to even the case where the temperature of the water-leachable alloy melt is increased to thus increase the rate of the diffusion reaction, as in the Example 2a.

In other words, it can be seen that the process of forming the bi-continuous structure between the alloy melt and the AMS precursor using the AMS process includes position swapping due to diffusion as a dominant process, and the rate of the diffusion process may be controlled so as to form the microstructure into a desired shape. For example, the porosity may be controlled by changing process conditions such as the immersion time in the alloy melt or the temperature of the melt. Further, a process for improving the diffusion rate in the melt, such as mechanical agitation, agitation using an electromagnetic field, or vibration of the melt using ultrasonic waves, may be additionally introduced during the AMS process, thereby reducing a process time.

Although the preferred embodiments of the present invention have been disclosed for illustrative purposes, those skilled in the art will appreciate that various modifications, additions and substitutions are possible, without departing from the technical idea of the present invention. Therefore, the scope of the present invention should be construed as being covered by the scope of the appended claims, rather than the specific embodiments, and all technical ideas falling within the scope of the claims should be construed as being included in the scope of the present invention.

What is claimed is:

1. A method of manufacturing a porous metal using a water-leachable alloy-melt-swapping process (AMS), the method comprising:

preparing a water-leachable alloy having excellent oxidation resistance;

preparing an AMS precursor including a composition having a relationship of both positive (+) and negative (−) heats of mixing with the water-leachable alloy elements;

manufacturing a bi-continuous structure alloy by immersing the AMS precursor in a water-leachable alloy melt prepared by melting the water-leachable alloy; and manufacturing the porous metal using dealloying, performed by immersing the bi-continuous structure alloy in pure water.

2. The method of claim 1, wherein preparing the water-leachable alloy having the excellent oxidation resistance is performed using a Ca-based alloy.

3. The method of claim 2, wherein the Ca-based alloy is represented by $Ca_xMg_{100-x}$ wherein $55 \leq x \leq 82$ at. %.

4. The method of claim 1, wherein preparing the AMS precursor includes manufacturing an AMS precursor having a composition including one or more elements selected from an element group II wherein element group II includes Ti, V, Cr, Mn, Fe, Co, Zr, Nb, Mo, Hf, Ta, W, and Re, which have the positive (+) heat of mixing, with element group I which comprises Ca and Mg and which are main elements of the water-leachable alloy, and one or more elements selected from an element group III wherein element group III includes Al, Si, P, Ni, Cu, Zn, Ga, Ge, As, Pd, Ag, Cd, In, Sn, Sb, Pt, Au, Hg, Tl, Pb, and Bi, which have the negative (−) heat of mixing with the element group I comprising Ca and Mg.

5. The method of claim 4, wherein the composition of the elements selected from the element group II and the elements selected from the element group III is $(\text{element group II})_{100-y}(\text{element group III})_y$ wherein $5 \leq y \leq 95$ at. %.

6. The method of claim 1, wherein manufacturing the bi-continuous structure alloy includes immersing the AMS precursor, which is obtained by alloying one or more elements selected from an element group II wherein element group II includes Ti, V, Cr, Mn, Fe, Co, Zr, Nb, Mo, Hf, Ta, W, and Re and one or more elements selected from an element group III, wherein element group III includes Al, Si, P, Ni, Cu, Zn, Ga, Ge, As, Pd, Ag, Cd, In, Sn, Sb, Pt, Au, Hg, Tl, Pb, and Bi in the alloy melt including an element group I which comprises Ca and Mg, so as to perform selective swapping of constituent elements, thus forming the bi-continuous structure alloy including the element group I and the element group II.

7. The method of claim 6, wherein manufacturing the bi-continuous structure alloy includes controlling a microstructure of the bi-continuous structure alloy by changing an immersion time of the AMS precursor in the alloy melt.

8. The method of claim 6, wherein manufacturing the bi-continuous structure alloy includes additionally introducing a process for increasing a rate of a diffusion reaction in the melt, which is selected from among mechanical stirring method, agitation using an electromagnetic field, and vibration of the melt using ultrasonic waves, thus changing a diffusion rate so as to control a microstructure of the bi-continuous structure alloy.

9. The method of claim 1, wherein manufacturing the porous metal via the dealloying using the water includes manufacturing a porous body including an element selected from element group II wherein element group II includes Ti, V, Cr, Mn, Fe, Co, Zr, Nb, Mo, Hf, Ta, W, and Re by dissolving the bi-continuous structure alloy composed of an element group I comprising Ca and Mg and the element group II in the water to thus perform the dealloying of the element group I.

10. The method of claim 9, wherein an internal porosity of the porous metal is controlled by adjusting y in a composition of the AMS precursor represented by $(\text{element group II})_{100-y}(\text{element group III})_y$ wherein $5 \leq y \leq 95$ at. %.

11. The method of claim 9, wherein an internal porosity of the porous metal is controlled by adjusting a time of the dealloying using the water.

* * * * *